US007736010B2

(12) United States Patent
Lee

(10) Patent No.: US 7,736,010 B2
(45) Date of Patent: Jun. 15, 2010

(54) REFRIGERATOR HAVING LAMP APPARATUS

(75) Inventor: Seung-Mok Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 7 days.

(21) Appl. No.: 12/195,971

(22) Filed: Aug. 21, 2008

(65) Prior Publication Data

US 2009/0052161 A1 Feb. 26, 2009

(30) Foreign Application Priority Data

Aug. 23, 2007 (KR) ..... 10-2007-0085141

(51) Int. Cl.
*F25D 27/00* (2006.01)

(52) U.S. Cl. ..... 362/92; 362/96; 362/126

(58) Field of Classification Search ..... 362/92, 362/96, 126

See application file for complete search history.

(56) References Cited

U.S. PATENT DOCUMENTS

| | | | | |
|---|---|---|---|---|
| 5,508,898 | A * | 4/1996 | McGovern | 362/92 |
| 7,201,487 | B2 * | 4/2007 | Pinter | 362/92 |
| 7,353,663 | B2 * | 4/2008 | Rafalovich et al. | 62/264 |
| 2002/0089842 | A1 * | 7/2002 | Santosuosso et al. | 362/92 |

* cited by examiner

*Primary Examiner*—Anabel M Ton
(74) *Attorney, Agent, or Firm*—Birch, Stewart, Kolasch & Birch, LLP

(57) ABSTRACT

A refrigerator having a lamp apparatus includes: a lamp receiving part formed at a recess portion of a rear wall surface of a storage space of the refrigerator; a light source unit installed at the lamp receiving part and being parallel to the rear wall surface of the storage space; and a lamp cover for diffusing light emitted from the light source unit. Because the light source unit and the lamp cover are provided at the lamp receiving part formed at a recess portion of the rear wall surface of the storage space of the refrigerator, both upper and lower ends of the storage space may be uniformly illuminated.

16 Claims, 6 Drawing Sheets

REFRIGERATOR HAVING LAMP APPARATUS

The present application claims priority to Korean Application No. 10-2007-0085141 filed in Korea on Aug. 23, 2007 the entire contents of which is hereby incorporated by reference in its entirety. cl BACKGROUND OF THE INVENTION 1. Field of the Invention The present invention relates to a refrigerator and, more particularly, to a refrigerator having a lamp apparatus capable of effectively illuminating the entire storage space without reducing the size of the storage space in the refrigerator.

2. Description of the Related Art

In general, a refrigerator is a home appliance for keeping food items in a refrigerated or frozen state for a long time by maintaining an internal temperature lower than a room temperature.

Refrigerators are divided into a top mount type refrigerator, a side-by-side type refrigerator, and a bottom freezer type refrigerator.

The top mount type refrigerator includes a refrigerating chamber at a lower side of a freezing chamber. The side-by-side type refrigerator includes a refrigerating chamber and a freezing chamber demarcated left and right side by side, in which a refrigerating chamber door and a freezing chamber door are open in both ways. The bottom freezer type refrigerator includes a refrigerating chamber provided at an upper portion and a freezing chamber provided at a lower portion.

In particular, the bottom freezer type refrigerator in which its upper refrigerator doors are open in both ways has a large internal space allowing more food items to be stored therein. In addition, because it can store a voluminous food item, the demands for the bottom freezer type refrigerators are on a sharp increase.

The various types of refrigerators include a lamp apparatus therein to allow users to easily view the internal storage space. Because all the sides of the interior of the refrigerator, except for the front side of the door, are covered by wall bodies, the internal lamp apparatus of the refrigerator is essential even for day time as well as night time.

However, the related art lamp apparatus of the refrigerator has the following problems.

That is, the related art lamp apparatus is commonly provided at an upper portion of the refrigerating chamber and the freezing chamber. Meanwhile, the refrigerating chamber and the freezing chamber include shelves or drawers on which various types of food items may be kept in storage. Thus, illumination emitted from the lamp apparatus is covered by the shelves, the drawers or the food items, failing to reach a lower end of the refrigerating chamber or the freezing chamber, so the lower portions of the refrigerating chamber and the freezing chamber are relatively dark.

In addition, the related art lamp apparatus emit heat in a turned-on state, resulting in an increase in the temperature in the freezing chamber and the refrigerating chamber. Thus, in order to maintain the temperature in the refrigerating chamber and the freezing chamber at a low temperature, a refrigerating cycle should operate additionally which, disadvantageously, increases power consumption.

SUMMARY OF THE INVENTION

Therefore, in order to address the above matters, the various features described herein have been conceived. One aspect of the exemplary embodiments is to provide a refrigerator having a lamp apparatus provided in a storage space of the refrigerator capable of effectively illuminating the entire storage space by improving the structure of the lamp apparatus.

This specification provides a refrigerator having a lamp apparatus, including: a lamp receiving part formed at a recess portion of a rear wall surface of a storage space of the refrigerator; a light source unit installed at the lamp receiving part and being parallel to the rear wall surface of the storage space; and a lamp cover for diffusing light emitted from the light source unit.

The lamp receiving part may be formed at a multi-duct cover having a plurality of discharge holes discharging cold air to the storage space and have a vertically long rectangular shape.

The lamp receiving parts may be symmetrically provided at left and right sides of the multi-duct cover having the plurality of discharge holes discharging cold air to the storage space and have a vertically long rectangular shape.

The light source unit may include: light sources formed by connecting a plurality of LEDs (Light Emitting Diodes) in a row; a light source insertion hole formed at an inner circumferential surface of the lamp receiving part and allowing the light source to be insertedly positioned; and a controller controlling the plurality of light sources according to opening or closing of the storage space.

The lamp cover may be a flat plate member having one side with a planar surface and an opposing side with grooves, in which the lamp cover is oriented such that the opposing side faces toward the light source unit.

The light sources may be positioned to face each other at both end portions of the grooves.

The lamp cover may be provided on an inner circumferential surface of the lamp receiving part to cover the light sources.

The light sources may be formed as LEDs emitting light of various colors.

The refrigerator having a lamp apparatus according to the present invention have the following advantages.

First, because the light source unit and the lamp cover are provided at the lamp receiving part formed at a recess portion of the rear wall surface of the storage space of the refrigerator, both upper and lower ends of the storage space may be uniformly illuminated.

Second, because the light source unit installed in the lamp receiving part is installed to be parallel to the rear wall surface of the storage space, the opened front side of the storage space is illuminated by reflected or diffused light, so eye-dazzling phenomenon due to a direct illumination can be removed.

Third, because the multi-duct cover where the lamp receiving part is formed is injection-molded separately and fixed to the rear wall surface of the storage space, the process of assembling the light source unit and the lamp cover to the multi-duct cover can be facilitated.

Fourth, because the LEDs are applied as the light sources, power consumption for operating the lamp apparatus can be reduced and the amount of heat according to the operation of the lamp operation can be reduced.

Fifth, because the lamp cover has one side with a planar surface and an opposing side with grooves, being oriented such that the opposing side faces toward the light source unit, light passing through the grooves can be externally diffused via the lamp cover, giving a quality and aesthetic sense to users.

The foregoing and other objects, features, aspects and advantages of the present invention will become more apparent from the following detailed description of the present invention when taken in conjunction with the accompanying drawings.

DETAILED DESCRIPTION OF THE INVENTION

The refrigerator having a lamp apparatus according to embodiments of the present invention will now be described with reference to the accompanying drawings.

Figure 1:
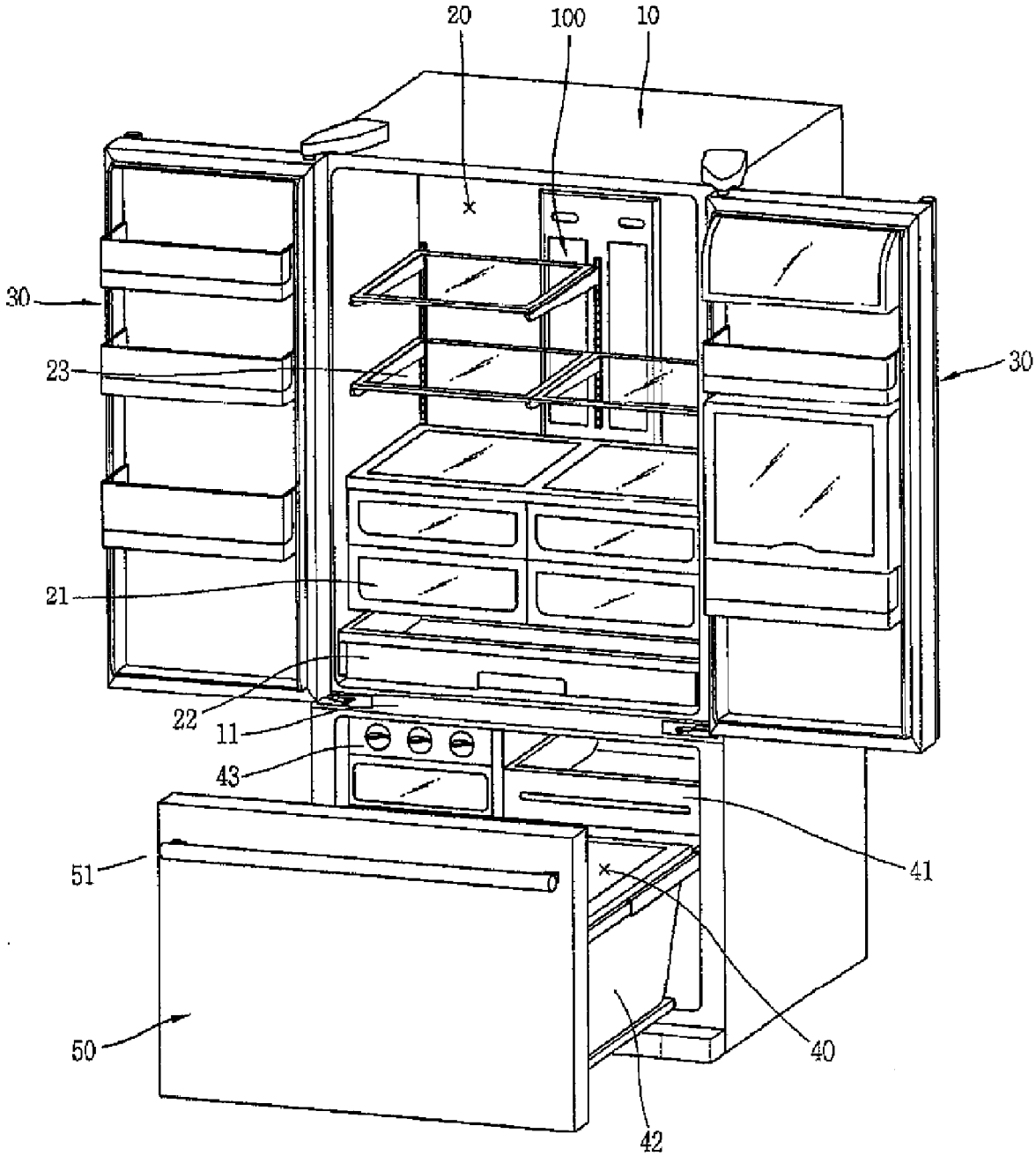
FIG. 1 is a front perspective view of a refrigerator having a lamp apparatus according to a first embodiment of the present invention.

FIG. 1 is a front perspective view of a refrigerator having a lamp apparatus according to a first embodiment of the present invention.

As shown in FIG. 1, the refrigerator having a lamp apparatus according to the present invention includes a main body 10 in the shape of rectangular parallelepiped. The interior of the main body 10 includes upper and lower storage spaces, namely, a refrigerating chamber 20 for refrigerating and keeping food items in storage and a freezing chamber 40 for freezing and keeping food items in storage, which are demarcated by a barrier 11.

The refrigerating chamber 20 and the freezing chamber 40 for independent spaces, and their front sides are open.

The opened front side of the main body 10 is selectively opened and closed by doors 30 and 50. The refrigerating chamber doors 30 close the refrigerating chamber 20 formed at the upper portion of the main body 10 and the freezing chamber door 50 closes the freezing chamber 40 formed at the lower portion of the main body 10.

The refrigerating doors 30 are formed at left and right sides, and end portions of the both sides are fixed to the main body 10 and rotated to selectively open and close left and right at the front side of the refrigerating chamber 20.

The interior of the refrigerating chamber 20 includes drawers 21, baskets 22, shelves 23, or the like to keep food items in various sizes and states in storage according to characteristics of each food item.

The shelves 23 provided in the refrigerating chamber 20 may be adjusted in its installation height as necessary.

The lower portion of the front surface of the main body 10, namely, the opened front side of the freezing chamber 40, is selectively closed by the freezing chamber door 50. The freezing chamber door 50 is provided such that it slidably moves in a forward/backward direction to selectively open or close the freezing chamber 40, and includes a freezing chamber door handle 51 protrusively formed at an upper portion thereof to allow the user to easily grasp it.

A plurality of drawers 41 and baskets 42 are provided at an inner side of the freezing chamber 40 to separately keep various food items in storage. A ice making unit 43 may be provided at one portion of the freezing chamber 40, and in this case, the ice making unit 43 may be provided at an inner side of the refrigerating chamber door 30 according to circumstances.

A lamp apparatus 100 is provided on a rear wall surface of the refrigerating chamber 20 and blinks according to opening and closing of the refrigerating chamber door 30. The lamp apparatus 100 will now be described in detail.

Figure 2:
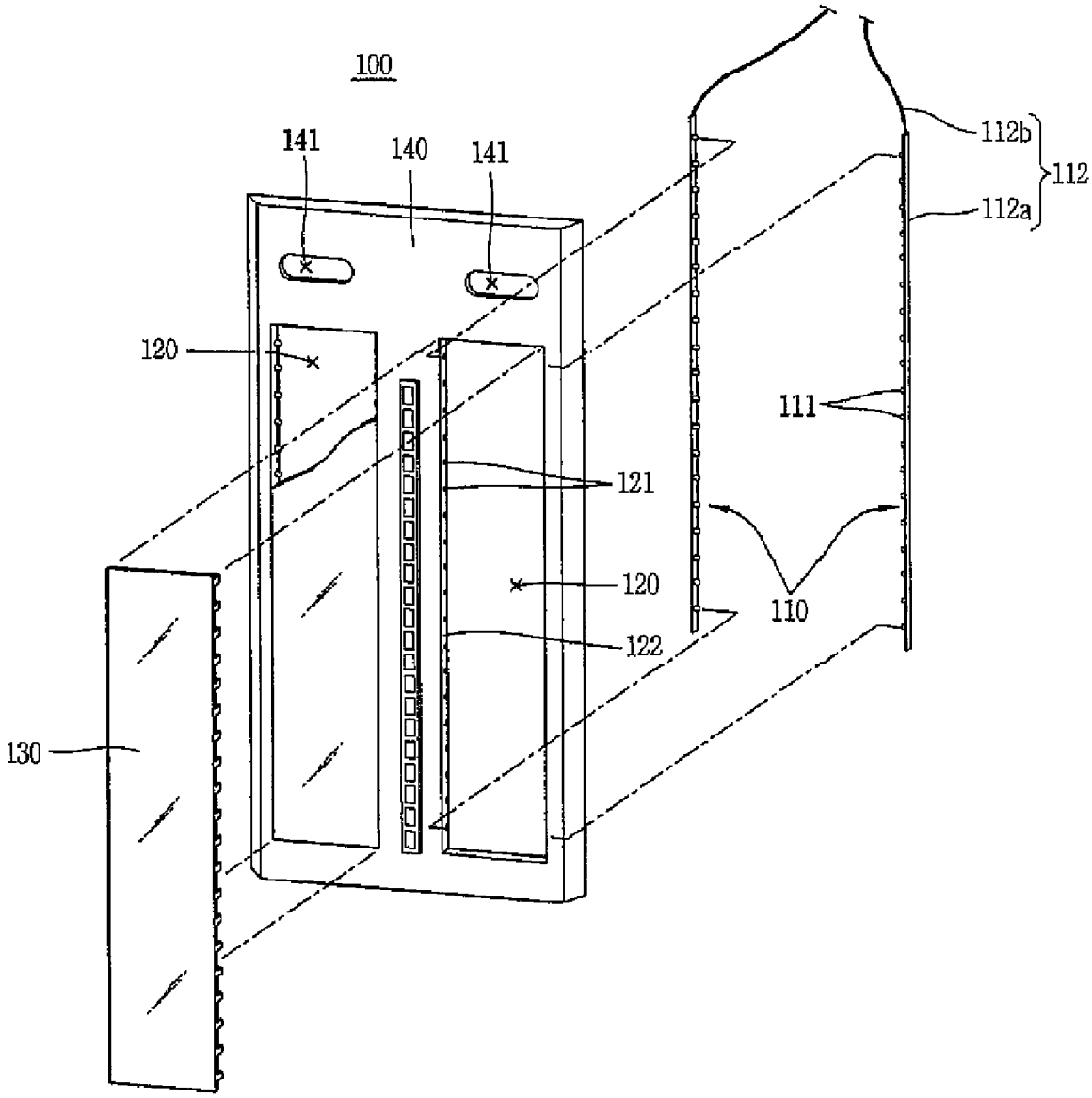
FIG. 2 is an exploded perspective view of the light apparatus in FIG. 1.

FIG. 2 is an exploded perspective view of the light apparatus in FIG. 1.

As shown in FIG. 2, the lamp apparatus 100 according to the first embodiment of the present invention includes a multi-duct cover 140 having cold air discharge holes 141 for supplying cold air to the refrigerating chamber 20, lamp receiving parts 120, a light source unit 110, and a lamp cover 130.

The multi-duct cover 140 is formed as a plate member with the plurality of cold air discharge holes 141 connected with a discharge opening (not shown) of the multi-duct provided to supply cold air heat-exchanged with an evaporator (not shown) of the refrigerator and discharging cold air to the refrigerating chamber 20, and fixed to the rear wall surface of the refrigerating chamber 20.

The multi-duct cover 140 may fixed to the rear wall surface of the refrigerating chamber 20 through a hook combining or by using an adhesive material.

The light receiving parts 120 are formed to be depressed with a certain depth on certain regions of a front surface of the multi-duct cover 140, and provided to a space where the light source unit 110 and the lamp cover 130.

The depressed regions refer to rectangular regions which are vertically long, and symmetrically formed at left and right portions of the multi-duct cover 140.

The depressed regions are not limited to the rectangular shape but may have various other shapes such as a circular shape and a heart shape.

The depth of the depressed regions correspond to a forward/backward directional width of both sides of the lamp receiving parts 20, in which the light source unit 110 can be sufficiently received.

The light source unit 110 will now be described in detail.

Figure 3:
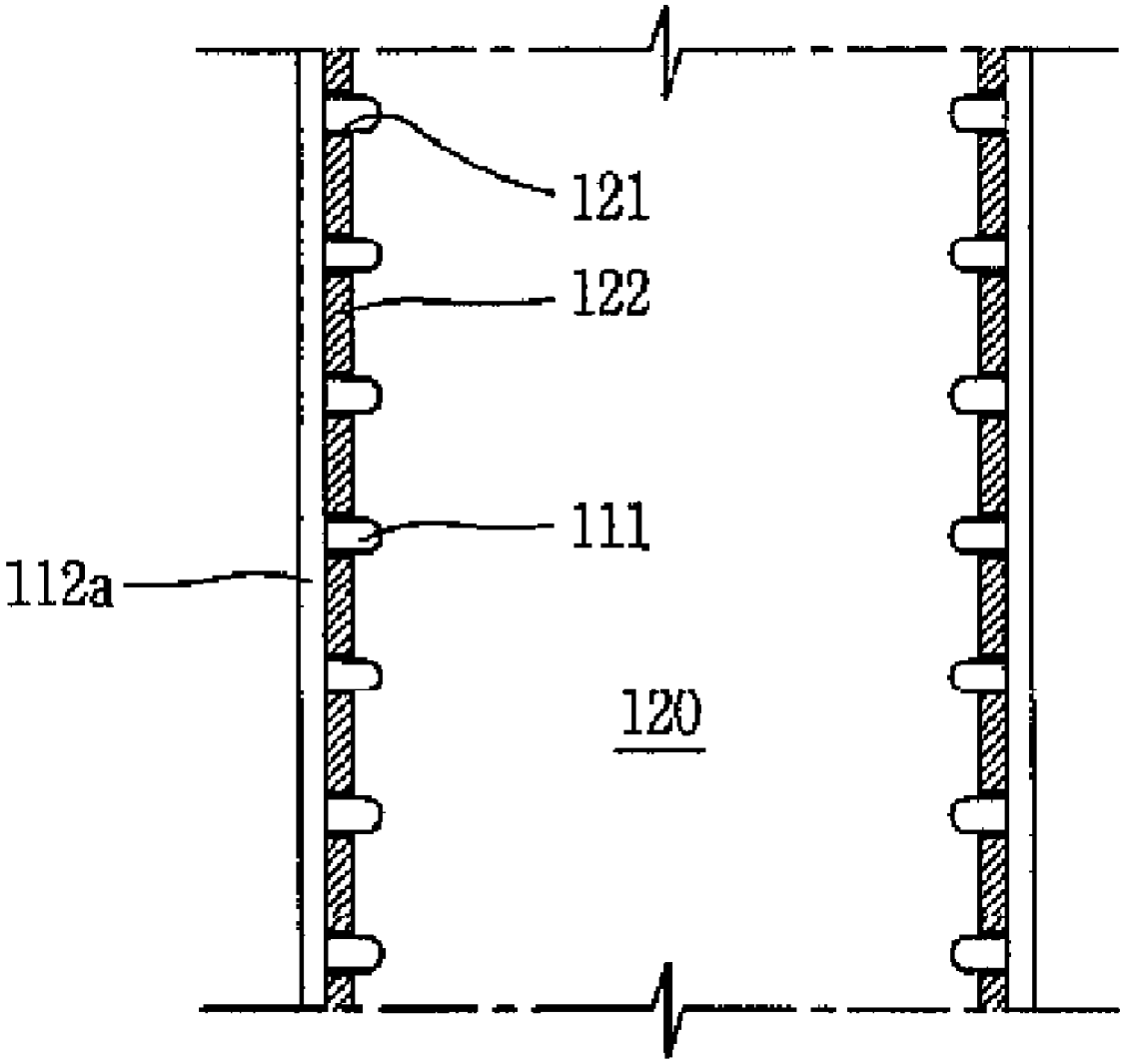
FIG. 3 is a sectional view showing a combined state of a light source unit to a lamp receiving part in FIG. 2.

FIG. 3 is a sectional view showing a combined state of a light source unit to a lamp receiving part in FIG. 2.

As shown in FIGS. 2 and 3, the light source unit 110 includes light sources 111, light source insertion holes 121 provided at the lamp receiving part 120 to allow the light sources 111 to be combined therein, and a controller 112 that controls blinking of the light sources 111.

The light sources 111 are formed of a plurality of LEDs (Light Emitting Diodes), and are arranged in a row at the controller 112.

The light source insertion holes 121 are formed at an inner circumferential surface 122 form the lamp receiving part 120, in particular, at both sides of the lamp receiving part 120, and are separately installed as long as the installation space of the LEDs to allow the LEDs to be combined therein.

The controller 112 includes a control board 112*a* for selectively supplying power to the plurality of LEDs according to an opening or closing of the doors 30 and 50 of the refrigerator, and a power supply line 112*b*. Namely, the controller 112 serves to supply power to the light sources 111. As mentioned above, the controller supplies power to the light sources 111 when the doors 30 and 50 of the refrigerator are open, and cuts off power supply to the light sources 111 when the doors 30 and 50 of the refrigerator are closed.

The controller 112 may include a circuit for controlling the color of light emitted from the light sources 111, to thereby maintain food items kept in storage in the refrigerator in an optimum state. That is, wavelength of emitted light varies according to the color of light, and in this respect, the freshness and the amount of nutrient of the stored food items, in particular, vegetables or the like, are adjusted according to the wavelength of light emitted thereto.

The lamp cover 130 will now be described.

Figure 4:
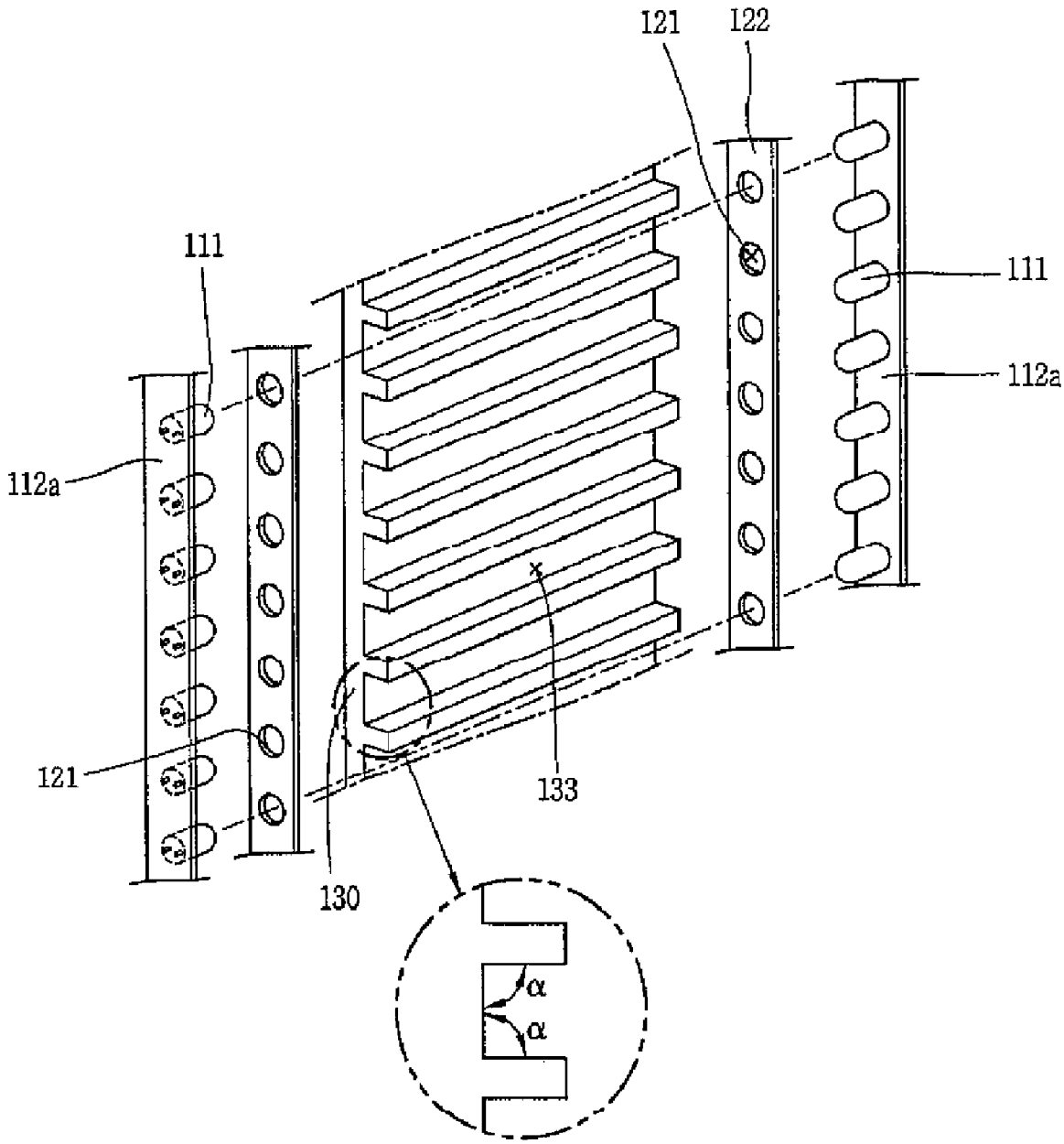
FIG. 4 is an enlarged view showing an inner surface of the lamp cover.

FIG. 4 is an enlarged view showing an inner surface of the lamp cover.

With reference to FIGS. 2 and 4, the lamp cover 130 is formed as a flat plate member to cover the lamp receiving parts 120. The shape of the lamp cover 130 corresponds to that of the lamp receiving part 120, and may have a fixing unit such as a hook so as to be combined to the lamp receiving part 120.

Grooves 133 are horizontally formed on an inner surface of the lamp cover 130, which faces the light source unit 110, and continuously provided along a vertical direction of the lamp cover 130.

The slope ($\alpha$) of the side of grooves 133 is 90° in FIG. 4, but the grooves 133 may be formed at various angles, and the slopes of the sides of the respective grooves 133 may be different.

The lamp cover 130 may be made of a translucent material such as glass or acryl allowing light emitted from the light source unit 110 to transmit therethrough.

The light source units 111 are positioned at both end portions of the grooves 133 in a facing manner. Accordingly, a plurality of stripe patterns are formed in a vertical direction of the light receiving parts 120 according to light illuminating the interior of the grooves 133, giving a quality and aesthetic sense to the user.

The operating process of the refrigerating having the lamp apparatus according to the first embodiment of the present invention will now be described.

When the doors 30 and 50 of the refrigerator are open by the user, the information about the opened doors 30 and 50 are transferred to the controller 112 that controls blinking of the light sources 111 and power is applied to turn on the light sources 111.

Light emitted from the turned-on light sources 111 mostly proceed to the side wall of the refrigerating chamber 20 and irradiated to pass through the grooves 133 formed on the inner surface of the lamp cover 130 that covers the lamp receiving parts 120 including the light sources 111. In addition, light is refracted or diffused from the sides of the grooves 133 to spread in all directions.

A refrigerator having a lamp apparatus according to a second embodiment of the present invention will now be described with reference to the accompanying drawings. The repeated content as that of the first embodiment described above will be omitted.

Figure 5:
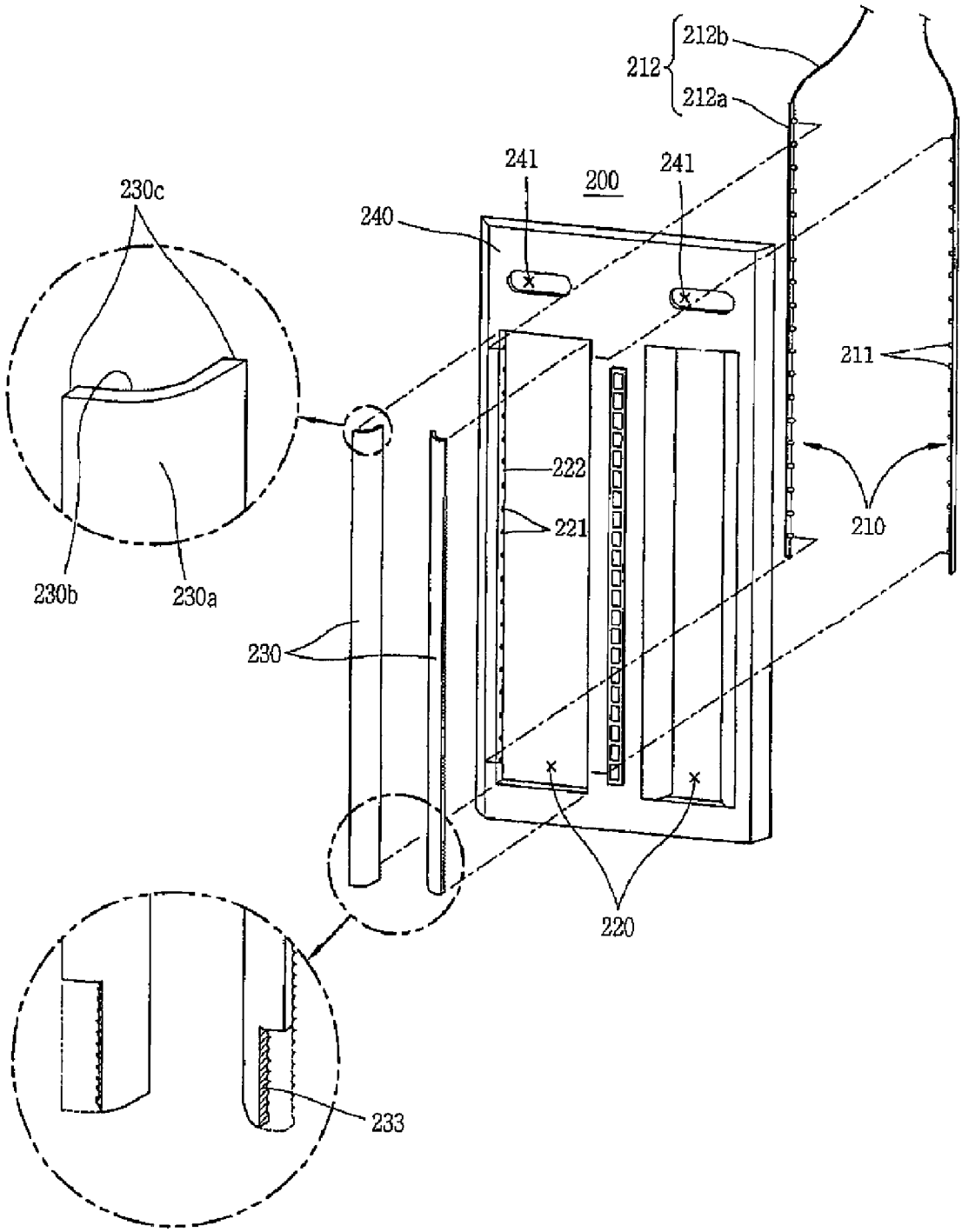
FIG. 5 is an exploded perspective view of a refrigerator having a lamp apparatus according to a second embodiment of the present invention.
Figure 6:
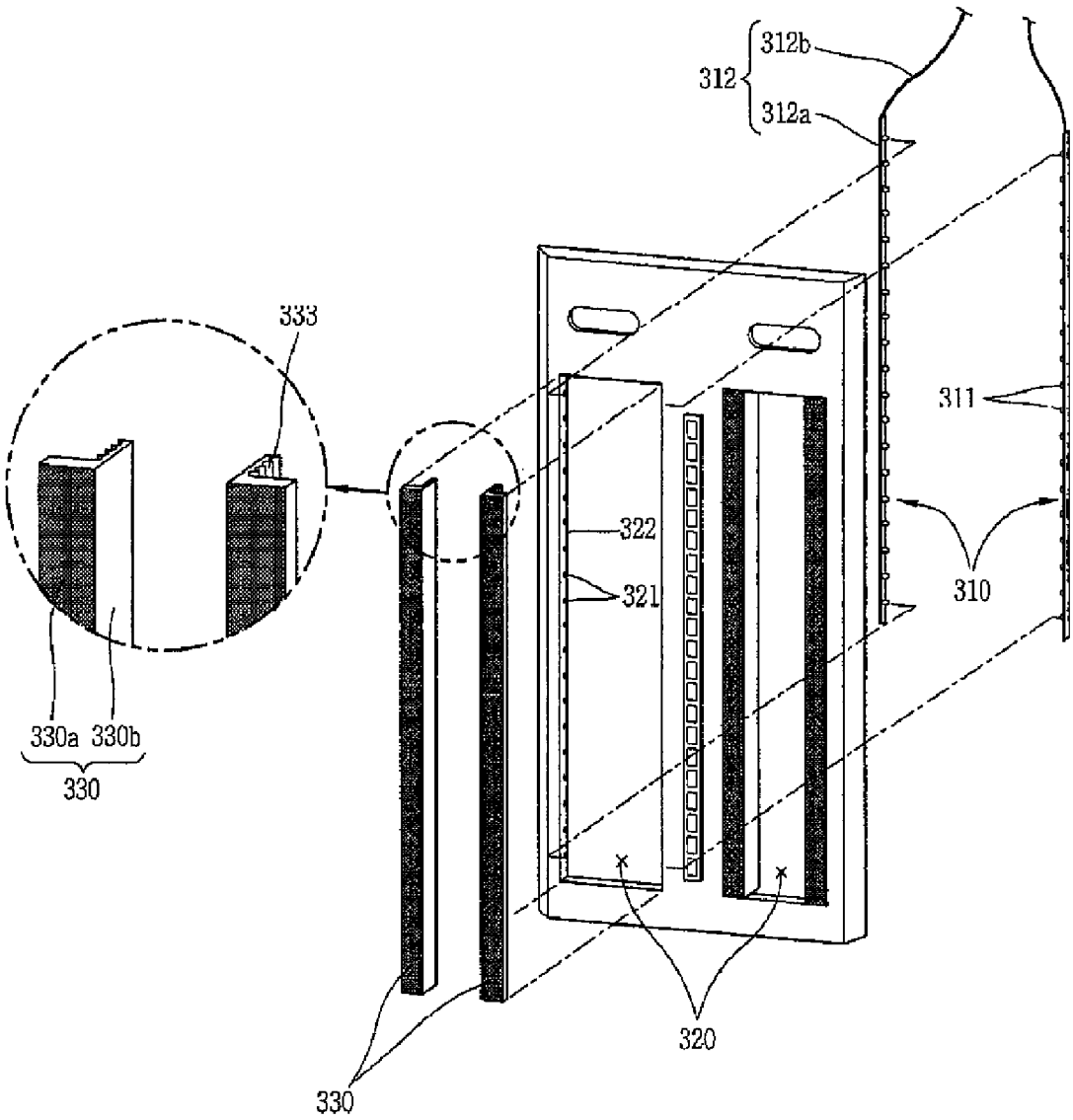
FIG. 6 is a view showing a modification of a lamp cover in FIG. 5.

FIG. 5 is an exploded perspective view of a refrigerator having a lamp apparatus according to a second embodiment of the present invention, and FIG. 6 is a view showing a lamp cover in FIG. 5.

As shown in FIG. 5, like the refrigerator having the lamp apparatus according to the first embodiment of the present invention as described, the refrigerator having a lamp apparatus 200 according to the second embodiment of the present invention includes a multi-duct cover 240 having cold air discharge holes 241 for supplying cold air to the refrigerating chamber, lamp receiving parts 220, a light source unit 210, a lamp cover 230.

The multi-duct cover 240 is formed as a plate member with the plurality of cold air discharge holes 241 connected with a discharge opening of the multi-duct provided to supply cold air heat-exchanged with an evaporator (not shown) of the refrigerator and discharging cold air to the refrigerating chamber 20, and fixed to the rear wall surface of the refrigerating chamber 20.

The light receiving parts 220 are formed to be depressed with a certain depth on certain regions of a front surface of the multi-duct cover 240, and provided to a space where the light source unit 210 and the lamp cover 230.

The light source unit 210 includes light source insertion holes 221 provided at both sides of the lamp receiving part 220 to allow light sources 211 to be combined therein, and a controller 212 that controls blinking of the light sources 211.

The lamp cover 230 does not cover the entire lamp receiving parts 220 but covers the inner circumferential surface of the lamp receiving parts 220, namely, the sides of the lamp receiving parts 220 to cover the light sources 211, and is made of a translucent material such as glass, acryl, or the like to allow light emitted from the light sources 211 installed to be vertical to the sides of the lamp receiving parts 220.

The lamp cover 230 may be formed by dividing an empty circular cylinder into quarters in a lengthwise direction. Namely, a front side 230*a* and a rear side 230*b*, which refract, reflect and transmit light, may be formed to have the shape of a circular arc.

The sides 230*c* of the lamp cover 230 are combined with the lamp receiving part 220, and the combined surfaces of the lamp receiving part 220 face each other at a right angle.

The rear side 230*b* of the lamp cover 230, namely, the surface facing the light sources includes depressions and protrusions 233 horizontally. The depressions and protrusions 233 are continuously provided along a vertical direction of the lamp cover 230.

The slope of the sides of grooves of the depressions and protrusions 233 may have various angles, and the slope of the sides of the grooves may be formed to be different.

Thus, because light emitted from the light sources 211 can be refracted in the vertical direction by the horizontal depressions and protrusions 233, even the sides of the refrigerator 20 can be extensively illuminated.

In addition, because the surfaces for refracting, reflecting and transmitting emitted light have the shape of a circular arc, the amount of light emitting toward the opened front side of the refrigerating chamber 20 can be minimized.

As shown in FIG. 6, the lamp cover 330 may be formed by dividing a hollow square pillar into quarters. Namely, the surfaces allowing light to be refracted, reflected and transmitted include a first surface 330*a* facing the front side of the refrigerating chamber 20 and a second surface 330*b* facing the side of the refrigerating chamber 20.

The first surface 330*a* is made of an opaque material to prevent light from being directly emitted to the opened front side of the refrigerating chamber 20.

The second surface 330*b* includes depressions and protrusions 333 vertically formed on its inner surface to allow a wide illumination to the sides of the refrigerating chamber 20. The depressions and protrusions 333 are continuously provided along a horizontal direction of the second surface 330*b*.

The operating process of the refrigerator having the lamp apparatus according to the second embodiment of the present invention will now be described.

When the refrigerating doors 30 are open by the user, the information of the opened doors 30 is transferred to the controllers 212 and 312 that control blinking of the light sources 211 and 311, and power is applied to turn on the light sources 211 and 311.

Light emitted from the turned-on light sources 211 and 311 mostly proceeds to the side walls of the refrigerating chamber 20 of the refrigerator and refracted by the depressions and protrusions 233 and 333 formed on the inner surfaces of the lamp covers 230 and 330 that cover the light sources 211 and 311, so illumination can be made in a wide range.

The present invention provides an illumination device comprising an elongated body having at least one elongated recess portion with opposing side walls forming a recess therebetween, an illumination unit located on at least one side wall of the elongated recess portion, and an illumination cover placed over the illumination unit to diffuse light emitted from the illumination unit, wherein the recess of the elongated body together with the illumination cover being made of an appropriate material and thickness, serve to reduce the amount of heat generated from the illumination device due to the illumination unit.

The elongated body, the illumination unit, and the illumination cover may be implemented within a compartment of a refrigeration apparatus. The elongated body, the illumination unit, and the illumination cover may be implemented at an interior rear wall in a lengthwise direction of the refrigeration apparatus. The elongated body may have an overall thickness that minimizes the amount of space occupied by the illumination device within the compartment of the refrigeration device. The elongated body may serve as a guide member for multiple ducts of the refrigeration apparatus.

The illumination unit may comprises a plurality of light emitting diodes arranged along the at least one side wall of the elongated recess portion. The illumination cover may have a plate-like configuration with elongated linear grooves formed in a parallel manner at a surface that faces the illumination unit and is attached to the elongated body to cover the entire length and width of the elongated recess portion. A pair of light emitting diodes may exist for each groove of the illumination cover, one light emitting diode respectively located at an is end of the groove such that the pair of light emitting diodes face each other. The illumination cover may be angled or curved to partially cover the illumination unit and has a corrugated surface that faces the illumination unit.

The appropriate material for the illumination cover should be sufficiently translucent and has thermal retention characteristics, and the thickness of the illumination cover should be sufficient to withstand heat while providing structural integrity. At least one of the elongated recess portion and the illumination cover may have internal surfaces with light reflective characteristics that improve light diffusion. The illumination device may further comprise a support rail mounted along a boundary between two adjacent elongated recess portions, the rail element allowing one or more detachable shelves to be attached thereto such that items can be placed thereon for storage in the refrigeration apparatus, while sufficient light is provided for the shelves by the illumination unit.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator having a lamp apparatus, comprising:

a lamp receiving part formed at a recess portion of a rear wall of a storage space of the refrigerator;

a light source unit installed at the lamp receiving part and being parallel to the rear wall of the storage space; and a lamp cover for diffusing light emitted from the light source unit, wherein the lamp receiving part is formed at a multi-duct cover having a plurality of discharge holes connected with a discharge opening of a multi-duct provided to supply cold air heat-exchanged with an evaporator of the refrigerator, the plurality of discharge holes discharge cold air to the storage space, the lamp receiving part having a vertically long rectangular shape.

2. The refrigerator of claim 1, wherein the lamp receiving part is provided in plurality, the lamp receiving parts being symmetrically provided at left and right sides of the multi-duct cover having the plurality of discharge holes discharging cold air to the storage space and have vertically long rectangular shapes.

3. The refrigerator of claim 1, wherein the light source unit comprises:

light sources formed of a plurality of LEDs (Light Emitting Diodes) connected in a row;

a light source insertion hole formed at an inner circumferential surface of the lamp receiving part to receive the light source; and a controller controlling the plurality of light sources according to opening or closing of the storage space.

4. The refrigerator of claim 3, wherein the lamp cover is a flat plate member having one side with a planar surface and an opposing side with grooves, in which the lamp cover is oriented such that the opposing side faces toward the light source unit.

5. The refrigerator of claim 4, wherein a pair of the light sources exist for each groove of the light source cover, each light source of the pair of light sources being located at respective ends of the groove such that the pair of light sources face each other.

6. The refrigerator of claim 3, wherein the lamp cover is provided on an inner wall of the lamp receiving part to cover the light sources.

7. The refrigerator of claim 3, wherein the light sources are LEDs that emit light of various colors.

8. The refrigerator of claim 2, wherein the light source unit comprises:

light sources formed by connecting a plurality of LEDs in a row;

a light source insertion hole formed at an inner side surface of the lamp receiving part and allowing the light source to be insertedly positioned; and a controller controlling the plurality of light sources according to opening or closing of a refrigerator door.

9. An illumination device comprising:

an elongated body having at least one elongated recess portion with opposing side walls forming a recess therebetween;

an illumination unit located on at least one side wall of the elongated recess portion; and an illumination cover placed over the illumination unit to diffuse light emitted from the illumination unit, wherein the recess of the elongated body together with the illumination cover being made of an appropriate material and thickness, serve to reduce the amount of heat generated from the illumination device due to the illumination unit, wherein the elongated body, the illumination unit, and the illumination cover are implemented at an interior rear wall in a lengthwise direction of a storage space of a refrigerator, and wherein the elongated body serves as a guide member for a multi-duct of the refrigerator, the elongated body having a plurality of discharging holes connected with a discharge opening of the multi-duct provided to supply cold air heat-exchanged with an evaporator of the refrigerator, the plurality of discharging holes discharging cold air to the storage space.

10. The device of claim 9, wherein the elongated body has an overall thickness that minimizes the amount of space occupied by the illumination device within the compartment of the refrigerator.

11. The device of claim 9, wherein the illumination unit comprises a plurality of light emitting diodes arranged along the at least one side wall of the elongated recess portion.

12. The device of claim 11, wherein the illumination cover has a plate-like configuration with elongated linear grooves formed in a parallel manner at a surface that faces the illumination unit and is attached to the elongated body to cover the entire length and width of the elongated recess portion.

13. The device of claim 12, wherein a pair of light emitting diodes of the plurality of light emitting diodes exist for each groove of the illumination cover, each light emitting diode of the pair of light emitting diodes being located at respective ends of the groove such that the pair of light emitting diodes face each other.

14. The device of claim 11, wherein the illumination cover is angled or curved to partially cover the illumination unit and has a corrugated surface that faces the illumination unit.

15. The device of claim 9, wherein the appropriate material for the illumination cover being sufficiently translucent and has thermal retention characteristics, and the thickness of the illumination cover being sufficient to withstand heat while providing structural integrity.

16. The device of claim 9, wherein at least one of the elongated recess portion and the illumination cover has internal surfaces with light reflective characteristics that improve light diffusion.

* * * * *